United States Patent [19]

Beymer

[11] 4,020,666

[45] May 3, 1977

[54] MOBILE FORMING MACHINE WITH EMBOSSING ROLLS

[76] Inventor: Glen E. Beymer, 83363 N. Enterprise, Creswell, Oreg. 97426

[22] Filed: Apr. 15, 1976

[21] Appl. No.: 677,156

[52] U.S. Cl. ..... 72/177; 72/181

[51] Int. Cl.[2] ..... B21D 5/06

[58] Field of Search ..... 72/177, 181, 226, 227, 72/228; 101/23, 32

[56] References Cited

UNITED STATES PATENTS

| | | | |
|---|---|---|---|
| 2,986,193 | 5/1961 | Howell | 72/177 X |
| 3,710,607 | 1/1973 | Beymer | 72/30 |

*Primary Examiner*—Milton S. Mehr

*Attorney, Agent, or Firm*—James D. Givnan, Jr.

[57] ABSTRACT

A mobile roll forming machine for the production of embossed metal siding at a siding installation site with the machine including a pair of adjustably mounted embossing rolls. A guide bar serves to divert the continuous sheet stock away from the embossing rolls to enable the optional production of unembossed or plain siding. A forming station removes sheet imperfections by imparting a transversely extending bowed configuration to the metal after passage of same past the embossing rolls. Adjustment means are operable to open or close the embossing rolls to vary the embossing action which may vary across a section of sheet stock for the purpose of contracting the metal to remedy linear curvature inherent in the rolled sheet stock. The run of sheet stock is reversed subsequent to embossing and passage past the first forming station for travel thereafter through the remaining roll sets of the machine which form marginal areas of the stock into siding configuration.

6 Claims, 5 Drawing Figures

MOBILE FORMING MACHINE WITH EMBOSSING ROLLS

BACKGROUND OF THE INVENTION

The present invention relates generally to mobile forming machines of the type producing metal siding for application to the exterior walls of building structures. The siding is formed from a roll of sheet metal stock which is entrained through multiple roll sets. The siding margins are progressively shaped by the roll sets to provide interlockable edges engaged with like edges on adjacent siding members. One such machine is disclosed in my earlier issued U.S. Pat. No. 3,710,607.

The application of metal siding to building structures, particularly houses, has found wide acceptance with the public for reasons of appearance as well as durability. Such siding is most efficiently manufactured at the work site with the mobile siding machine enabling the cutting of the siding formed at specific lengths to custom fit the wall being covered. Recently, embossed siding has been introduced and has been very favorably accepted apparently for the reason it more nearly simulates wood siding in that a texturized appearance is provided by such embossing. Embossed siding, heretofore produced only in plant operations, required costly shipping to the work or installation site. Over and above the inherent problems encountered in the shipping of pre-cut, easily bent panels to the work site is the problem of the embossed or raised surfaces on the panels rubbing against one another during shipment resulting in the marring of the painted panel surfaces. Another drawback to shipping of panels resides in the packaging required to prevent damage in transit.

SUMMARY OF THE PRESENT INVENTION

The present invention is embodied within a compact, mobile roll forming machine for the production of embossed metal siding of the type applied to exterior wall surfaces. The present machine is additionally capable of forming unembossed or plain metal siding.

The present improvement to mobile siding machines includes a set of embossing rolls in association with guide means for diverting the continuous sheet stock past the embossing rolls for the production of plain or unembossed siding. For the sake of compactness, important to a trailer or truck mounted siding machine, embossing is performed during travel of the sheet stock in one direction with the stock entrained about a reversing roll for subsequent passage through the remaining roll forming sets of the machine. Intermediate the embossing rolls and said reversing roll a forming station is provided imparting a crosswise curvature to the passing sheet stock. The curvature imparted enhances siding appearance by removing random deformations in the rolled stock. The curvature imparted, while slight, is also effective to inhibit what is commonly referred to as "oil canning" or slight bends imparted to the metal during its application to a wall.

Important objects of the present invention include: the provision of embossing rolls on a mobile forming machine enabling a one roll forming machine to produce embossed siding as well as smooth surfaced siding; the provision of guide means for optional diverting of the passing sheet material so as to circumvent the embossing rolls for the production of unembossed siding; the provision of a set of embossing rolls in stacked relationship to the machine's roll sets so as to not increase the length of the siding machine; the provision of embossing rolls which may be adjusted relative to one another so as to exert varying degrees of contraction on the passing sheet which contraction may vary transversely of the sheet for the purpose of correcting a linear curvature defect common in rolled sheet stock; and the provision of a siding machine having forming means imparting a transverse curvature to the sheet stock so as to impart a slight, transverse arc thereto to obviate "oil canning" of the siding when applied to a structure.

DETAILED DESCRIPTION OF THE PREFERRED EMBODIMENT

Figures 1, 2, 3, 4, 5:
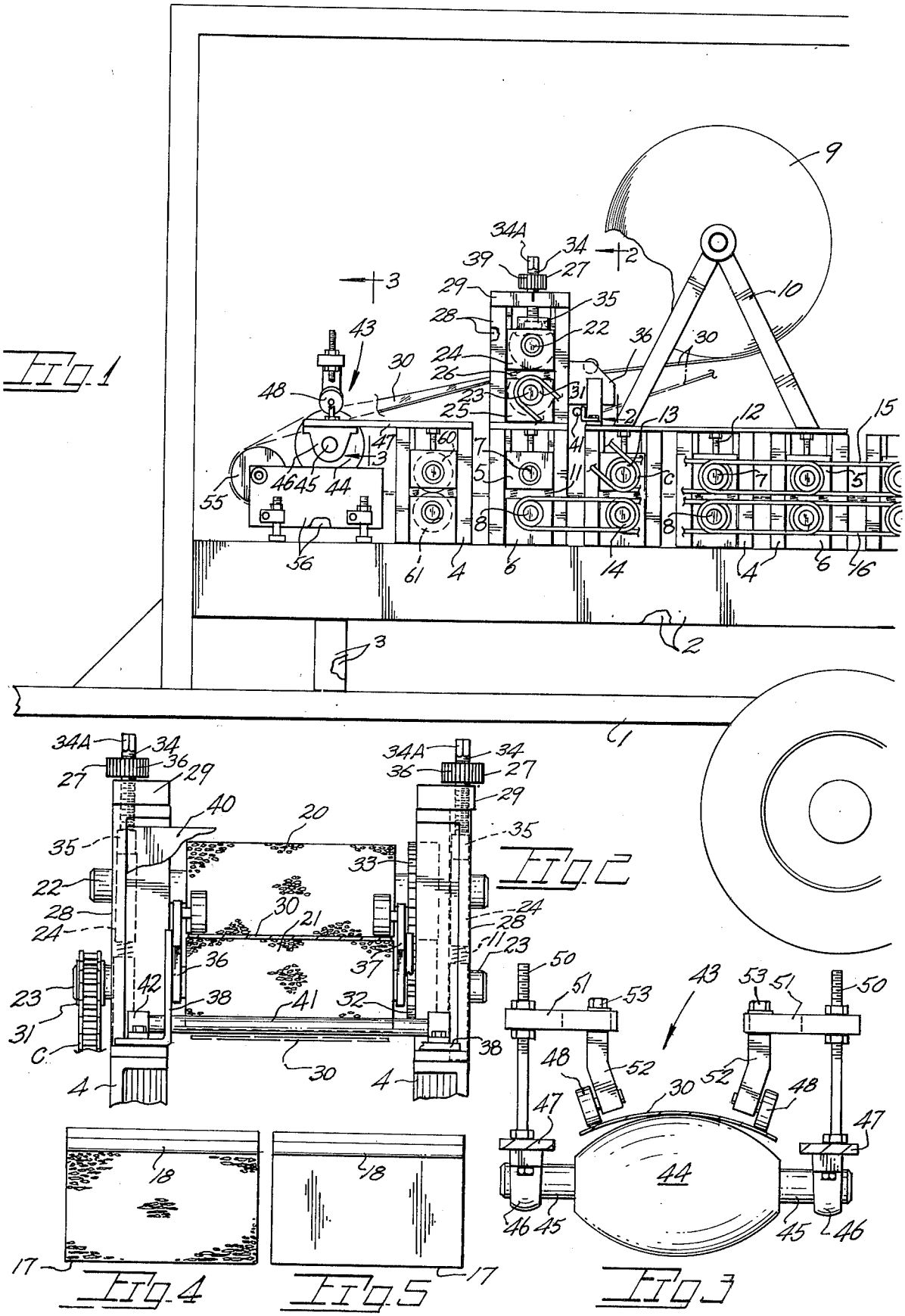
FIG. 1 is a partial side elevational view of a siding machine embodying the present improvement.
FIG. 2 is an elevational view of the embossing rolls and guide means taken approximately along line 2—2 of FIG. 1.
FIG. 3 is a vertical elevational view taken approximately along line 3—3 of FIG. 1.
FIG. 4 is a plan view of an embossed siding section.
FIG. 5 is a plan view of an unembossed siding section.

With continuing reference to the accompanying drawing wherein applied reference numerals indicate parts similarly identified in the following specification, the reference numeral 1 indicates a wheel supported chassis on which is suitably supported a machine frame comprising parallel spaced apart frame members 2 secured in place on the chassis by supports 3.

In place along machine frame members 2 are pairs of opposed, aligned bearing supports 4 within each of which are retained upper and lower bearing blocks 5 and 6 in which are journalled the ends of upper and lower shafts 7 and 8 each of which serves to carry metal forming roll elements. The cooperating roll elements on paired shafts 7 and 8 constitute roll sets which progressively shape the metal stock drawn from a supply reel 9 rotatably supported at 10. The upper provide spacing between the upper and lower roll elements of a roll set with upward displacement of the upper bearing blocks limited by adjustment means at 12. Powering the roll carrying shafts 7 and 8 is a roller chain drive arrangement with roll carrying shafts 7 and 8 having double sprockets 13 and 14 thereon on which are entrained roller chains in series at 15 and 16. A power source in the form of a frame mounted electric motor (not shown) is in driving engagement with a lower roll shaft which, in turn, is in geared driving engagement with its companion upper roll shaft with power being transmitted to the remaining upper and lower roll shafts by the above mentioned roller chain drive arrangement. The foregoing is embodied in existing forming machines with a more detailed explanation of machine structure being provided in above mentioned U.S. Pat. No. 3,710.607. The siding produced by the forming machine characteristically includes an inwardly directed flange 17 (FIGS. 4 and 5) with a doubled flange at 18 to provide a "Pittsburgh" lock between successive panels.

The present invention concerns the provision of an embossing roll set including upper and lower roll members 20 and 21. In similarity to the above mentioned roll sets, roll members 20–21 are mounted on upper and lower shafts at 22–23 within upper and lower pairs of bearing blocks at 24–25. Spring elements 26 assure spacing between the nip of roll members 20–21 with the upper bearing blocks being confined against upward displacement during sheet stock passage by roll adjustment means 27. Bearing support structures at 28 are spaced apart on opposite sides of the sheet stock run at 30 and are conveniently mounted on a subjacent pair of bearing supports 4 associated with an earlier described roll set. Bearing supports 28 each include a crosspiece 29 which is internally threaded to receive adjustment means 27. Lower shaft 23 is sprocket equipped at 31 and driven by a chain C with motion imparted to upper roll shaft 22 via pinion gears 32–33 (FIG. 2). The powered embossing rolls 20 and 21 have corresponding high and low areas which jointly act on opposite surface areas on the passing stock to form an irregular surface thereon simulating the surface of wood siding.

Regulation of the embossing action is determined by the clearance between the nip of the rolls which clearance is controlled by aforementioned adjustment means 27 on each support structure 28. Each adjustment means 27 includes a threaded shaft 34, the lower end of which is rotatably confined within a keeper 35 on bearing block 24. An indicator at 39 is fixed to shaft 34 which terminates upwardly in wrench receiving flats 34A. Indices about the exterior of indicator 39 permit operator adjustment of the respective end of upper roll shaft 22 and hence nip clearance. Importantly, as each end of upper roll shaft 22 is positionable by its respective adjustment means, the embossing action or depth of embossment may be varied transversely across the metal stock to enable the machine operator to compensate for undesired linear curvature of the rolled sheet stock. Such curvature often occurs during the manufacturing process of rolled metal stock and will result in the stock, when unrolled, having a slight divergence from an optimum or straight course. While such an imperfection will not hinder machine operation, a problem arises in applying the slightly curved panel to the building structure. Manually applying a straightening force to the panel will cause same to buckle or "oil can". Such is remedied in the present machine by reducing the nip clearance at one end of the rolls to increase the embossing depth which in turn provides a contracting effect on one marginal area of the passing metal stock.

For purposes of laterally constraining the moving stock for embossing roll engagement I provide roller equipped side plates at 36 and 37 supported by a pair of brackets at 38. A hand guard is indicated at 40.

For diverting the moving sheet stock past embossing rolls for the production of plain or unembossed siding, a guide bar at 41 is provided secured by brackets 42. In FIGS. 1 and 2 a segment of sheet stock 30 is shown in broken lines being diverted along a path vertically offset from the embossing rolls.

To switch from the production of embossed siding panels to unembossed or plain siding panels it is merely necessary to re-entrain the leading end of same beneath guide bar 41 and thence about a later described reversing roll and into engagement with the powered roll sets earlier described.

Indicated generally at 43 is a forming station for sheet stock bending and through which the stock passes for the purpose of imparting a transverse arc or bow to the stock. A uniform, slightly bowed configuration of the stock contributes to the siding's appearance when applied to a structure wall by obviating lengthwise extending waves. Bending station 43 as best shown in FIG. 3, includes a roll 44 carried by a shaft 45 journalled in bearing pillow blocks 46. Plates at 47 project outwardly from bearing support structures 4 to carry said bearing blocks. Roll 44 has a transversely curved surface on which the moving sheet stock rides while hold down rollers 48 serve to confine the marginal areas of the sheet against upward displacement by the roll. The transversely orientated bow or curve imparted to stock by the approximately eight inch diameter roll is somewhat less than the curvature viewed in FIG. 3 by reason of the flexible nature of the stock. Hold down rollers 48 are adjustable with respect to roll 44 to permit varying of the bowing effect imparted to the sheet. Upright threaded stems at 50 carried by plates 47 adjustably mount slotted arms 51 while roller carrying brackets 52 are adjustable transversely by means of the brackets' upper ends being slidably and rockably mounted at 53 within said slotted arms 51.

A reversing roll 55 receives the sheet stock from bending station 43 with the stock thereafter passing rearwardly between plates 56, each equipped with rollers to facilitate sheet passage therethrough. The roll forming of the sheet stock into the panels is accomplished by the machine roll sets acting on the sheet in the usual manner. A set of idler rolls at 60 and 61 on shafts 62 and 63 include rotating punching die for the cutting of closely spaced openings along one margin of the sheet stock to facilitate later nailing of the panel into place. Additionally, the sheet stock may be punched at intervals by roll sets acting on the opposite marginal area of the stock thereby providing "weep" holes for venting condensation. For synchronization of the upper and lower roll sets 60 and 61 the same are in geared engagement. The above mentioned punching of the moving sheet stock and the subsequent progressive formation of the metal stock marginal areas are not part of the present invention but rather are mentioned simply for explanatory purposes of machine operation. A detailed description of subsequent forming operations by the remaining roll sets is provided in the above mentioned U.S. patent.

While I have shown but one embodiment of the invention, it will be apparent to those skilled in the art that the invention may be embodied still otherwise without departing from the spirit and scope of the invention.

Having thus described the invention, what is desired to be secured under a Letters Patent is:

1. In a mobile roll forming machine for the production of metal siding at a siding installation site, said machine having roll sets stationed along the path of a run of light gauge metal stock, the improvement comprising,
   - a set of embossing rolls between which the metal stock may pass,
   - adjustment means associated with each end of an embossing roll to vary embossing roll spacing, and
   - guide means for diverting the moving metal stock out of embossing roll engagement enabling the optional production of unembossed metal siding.

2. The improvement claimed in claim 1 wherein said set of embossing rolls are in a plane upwardly offset from a plane containing other roll sets of the machine, said improvement additionally including a reversing roll about which the stock is entrained.

3. The improvement claimed in claim 2 additionally including a bending station receiving metal stock after passage past said embossing rolls and imparting a transverse curvature to the moving metal stock.

4. The improvement claimed in claim 3 wherein said set of embossing rolls and said bending station act on the metal stock prior to stock entrainment about the reversing roll.

5. The improvement claimed in claim 1 wherein said adjustment means includes independently adjustable members associated with opposite ends of one of said embossing rolls whereby the embossing action on passing stock may vary transversely of the stock for the remedy of linear curvature in the stock.

6. The improvement claimed in claim 1 wherein said guide means comprises a bar disposed crosswise to the passing metal stock.

* * * * *